US007500575B2

(12) United States Patent
Zhang

(10) Patent No.: US 7,500,575 B2
(45) Date of Patent: Mar. 10, 2009

(54) CRANE TRIM, LIST, SKEW AND SNAG PROTECTION SYSTEM

(75) Inventor: Dianren Zhang, Tacoma, WA (US)

(73) Assignee: Caper, Phillips & Associates, Tacoma, WA (US)

( * ) Notice: Subject to any disclaimer, the term of this patent is extended or adjusted under 35 U.S.C. 154(b) by 21 days.

(21) Appl. No.: 11/605,783

(22) Filed: Nov. 28, 2006

(65) Prior Publication Data

US 2008/0121602 A1 May 29, 2008

(51) Int. Cl.
*B66C 11/00* (2006.01)

(52) U.S. Cl. ..... 212/323; 212/274

(58) Field of Classification Search ..... 212/323, 212/274

See application file for complete search history.

(56) References Cited

U.S. PATENT DOCUMENTS 1,004,451 A * 9/1911 McIntyre ..... 212/76
6,267,211 B1 * 7/2001 Heintzmann et al. ..... 192/3.23
2006/0085118 A1 * 4/2006 Baldwin ..... 701/50

FOREIGN PATENT DOCUMENTS

SU 933614 * 6/1982

* cited by examiner

*Primary Examiner*—Thomas J. Brahan
(74) *Attorney, Agent, or Firm*—Mark S. Hubert

(57) ABSTRACT

The present invention utilizes a hoist drum with a number of different diameter sections upon which the different ends of a lifting cable simultaneously spool on and off of as a function of counterclockwise and clockwise cable spooling. This combination reduces the amount of shaft torque required to raise or lower a load while increasing the number of hoist drum rotations required to raise or lower that load. These two features are incorporated into the operation of a main crane cable length adjusting device since they offer precise and rapid adjustment capabilities to be made with smaller sized electric motors and clutches.

5 Claims, 8 Drawing Sheets

CRANE TRIM, LIST, SKEW AND SNAG PROTECTION SYSTEM

BACKGROUND OF THE INVENTION

The present invention relates to an improved hoisting apparatus that, through the use of a dual diameter or tapered drums and opposite direction wire rope wrapping, reduces the shaft torque required to lift a load with respect to that seen in conventional hoisting systems. With differing drum diameter sections, the shaft torque for the same operation may be positive, zero or negative. This improved design, besides allowing for smaller drum rotating mechanical equipment, has wide applications in the hoisting and craning industry. One of the applications is for use as a container crane's trim, list, skew and snag protection system (TLSS).

Container cranes hoist containers with four individual wire ropes. For purposes of simplification in explanation, each wire rope runs to a corner of a lift beam connected to the container. By controlled take up and let out of these four wire ropes the operator of the crane can force a container to tilt in the x axis, the y axis or yaw about a vertical z axis. In the craning industry these motions are called list, trim, and skew. In aircraft terms, these would be termed limited roll right and left, limited pitch nose and tail, and limited yaw clockwise and counterclockwise. (TLS) By adjusting these motions a suspended container can be forced to align better as it is moved on and off a ship and on or off a truck.

A snag occurs when a hoist is lifting a lift beam at high speed and the lift beam hangs up in a ship's hold, or alternatively, when the lift beam fails to stop when it reaches the underside of the hoist trolley. Although there is a significant amount of stretch in long wire ropes, once a snag occurs, if the upward lift of the crane is not stopped, damage will occur. Stopping the upward motion of the lift beam is not immediate as the hoist machinery keeps turning by virtue of its own flywheel inertia. The rotating kinetic energy associated with that flywheel inertia must be converted to heat, elastic strain or deformation. A typical snag a event only lasts about 0.3 seconds. For this reason container cranes must be equipped with a fast acting snag system.

Numerous prior art systems have been devised for both TLS and for snag. Most of these incorporate hydraulic cylinders in some manner. The most popular system combines four individual cylinders to serve all four functions. With this type of system, the same cylinder that can adjust wire rope length to perform one or more TLS functions can also release the wire rope in a controlled manner when needed for snag events. As a cylinder releases the wire rope, hydraulic oil flows through a metered orifice heating the oil and thereby absorbing much of the hoist flywheel energy. One problem with such prior art system, is that while a small cylindrical stroke is enough for TLS adjustment, snag compensation requires a large cylinder stroke. The control sensitivity for combining these large and small strokes on the same cylinder results in a poorly operating system for all four functions. Even the speed for trim and list is incompatible with the super sensitivity needed to control skew. For that reason crane operators prefer to separate TLS systems from snag systems and want adjustable speeds for the TLS features. A secondary problem with such prior art systems is hydraulic oil. Hydraulic systems usually leak and require a considerable amount of maintenance.

Stand alone mechanical TLS systems are already available, but are more expensive than hydraulic systems that can serve the same function. The combination mechanical TLS and hydraulic snag is a solution, but is too costly to be popular.

The present invention is a TLSS system that incorporates a drum with at least two different diameter sections upon which the different ends of a lifting wire rope simultaneously spool on and off of as a function of counterclockwise and clockwise drum rotation. The wire rope rides around an equalizing sheave which is rotatably connected to another equalizing sheave around which one of the main crane wire ropes ride. Altering the drum wire rope length moves the duo sheave assembly and causes the main crane wire rope's vertical length to be altered. The differing TLSS drum diameters act to alter the amount of shaft torque required to adjust the main crane wire rope length and increases the number of drum rotations required to do so. By using various combinations of multiple drum regions with different drum diameters, a precise, fast acting mechanical TLSS system using conventional electric motors can be designed for a crane's specific configuration.

Henceforth, a tapered TLSS drum and opposite direction wire rope wrapping would fulfill a long felt need in the hoisting industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a crane apparatus that operates with an adjustable, reduced torque load over that of conventional assemblies.

It has many of the advantages mentioned heretofore and many novel features that results in a new crane trim, list, skew and snag protection apparatus which is not anticipated, rendered obvious, suggested, or even implied by any of the prior art, either alone or in any combination thereof.

In accordance with the invention, an object of the present invention is to provide an improved system for altering the tilt, list and skew lifting functions of a container crane.

It is another object of this invention to provide an improved system capable of meeting or exceeding current remedial action response times for a crane snag.

It is a further object of this invention to provide an improved system that is adapted for finer control over the tilt, list and skew lifting functions of a container crane.

It is still a further object of this invention to provide for a TLSS drum designed with multiple, different diameter sections that may be designed, built and operated in conformity with a specific crane's trim, list, skew and snag protection (TLSS) needs.

It is yet a further object of this invention to provide a safer and quicker responding snag protection system with emergency torque reversal for snag events that exceed the normal demand of wire rope extension.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1A:
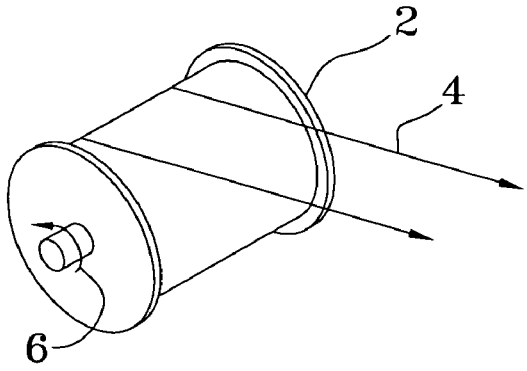
FIG. 1a PRIOR ART
FIG. 1*a* is a front perspective view showing the general arrangement of a conventional prior art hoist drum and wire rope.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Figure 1B:
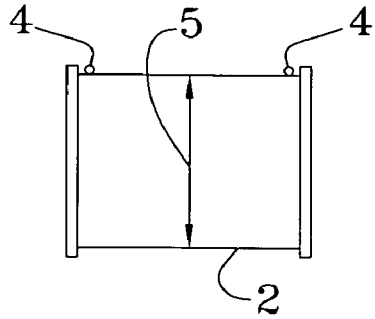
FIG. 1*b* is a side cross sectional view of a conventional prior art hoist drum and wire rope

Referring to FIGS. 1*a* and 1*b*, it can be seen that the prior art hoist drum and wire rope arrangement has both ends of the wire rope 4 wound in the same direction at opposite sides of a constant diameter drum 2. In this manner, any rotation of the drum 2 retracts or pays out the same amount of wire rope 4 from either side of the drum 2. Here the amount of shaft torque (Y) (denoted by arrow 6) required to raise a load is the lifting force or sum of all the tensions multiplied by the drum radius (R). Since there is equal tension on both wire ropes (T) and because the radius is ½ the drum diameter, shaft torque (Y1)=(2T)×(D/2)=TD. Each full revolution of the drum will raise the load by the diameter of the drum (D) multiplied by pi π (the drum circumference), multiplied by 2 wire ropes and ÷½ (for the midpoint of the wire rope). Load Lift=D π

Figure 4A:
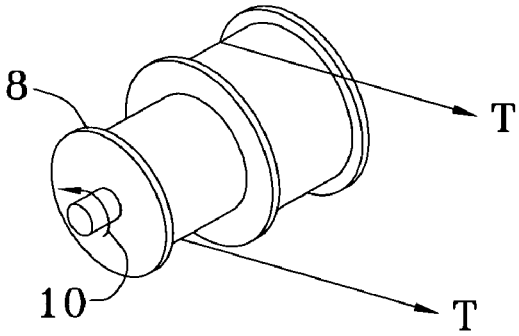
FIG. 4*a* is a perspective view showing the general arrangement of a dual diameter, opposite wire rope wrapped drum.
Figure 4B:
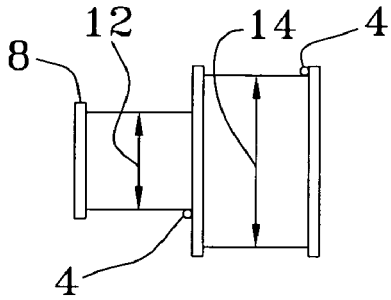
FIG. 4*b* is a side cross sectional view of a dual diameter, opposite wire rope wrapped drum.

Looking at FIGS. 4*a* and 4*b*, the simplest of the TLSS drum designs of the present invention, it can be seen that the fundamental TLSS drum and wire rope arrangement has the ends of the wire rope 4 wound in opposite directions at opposite sides of a dual diameter drum 8. In this manner, any rotation of the dual diameter drum 6 retracts and pays out different amounts of wire rope 4 simultaneously from either side of the drum 6. Here, the amount of shaft torque (Y2) (denoted by arrow 10) required to raise a load is the amount of lifting force times the diameter of the raising drum section (D') (denoted by arrow 14) reduced by the amount of lowering force times the diameter of the lowering drum section (d') (denoted by arrow 12). This is (TD'/2)−(Td'/2)=(T/2)(D'−d').

(Note again there is equal tension (T) on both wire ropes.) Each full revolution of the drum 8 will raise the load (Load Lift) by the diameter of the large drum (D') multiplied by pi π (the drum circumference)−the diameter of the small drum (d') multiplied by pi π (the small drum circumference)÷½. Load Lift=(D'−d')/2π

Hence, in the arrangement of FIG. 1*a* if the drum diameter 5 (D) was 2 feet and the load to be lifted was 10 tons, the shaft torque (Y)=(2 ft/2)×5 tons×2 wire ropes=10 ft. tons. Each complete revolution of the drum would lift the load (D π). This is 2π ft.

However, in the arrangement of FIG. 4*a* if the large drum diameter 14 (D") was 2 feet, the small drum diameter 12 (d') was 1.5 feet and the load to be lifted was 10 tons, the shaft torque (Y)=(T/2)(D−d)=(5 ton/2) (2 ft−1.5 ft)=1.25 ft. tons. Each complete revolution of the drum would lift the load (D−d)/2π. This is 0.25π ft.

As can be seen in this comparison, opposite wrapping of the drum wire ropes onto drums having a 4/3 ratio of their diameters decreases the amount of torque required to raise the same load by a factor of 8 (10 ft/tons÷1.25 ft/tons) but requires 8 times the number of drum revolutions to raise the load through the same distance. Simply stated, where opposite wrapped wire ropes are spooled onto different diameters, the desired shaft torque can be obtained by altering the ratios of the drum diameters. Essentially the TLSS drum itself functions as a torque/gear reducer and provides for a slower takeup/payout of wire rope. This allows the use of smaller powered TLSS drum motors, a longer response time and most importantly, smaller friction clutches or friction brakes.

Now that the basic design of the present invention has been disclosed, the specific embodiments and their applications as part of a TLSS system for a container crane can best be explained. Note that although (for purposes of explanation) these embodiments are directed to use on a container crane, they are appliwire rope to a plethora of other applications, craning related or otherwise that would be well known to one skilled in the art.

Figure 2:
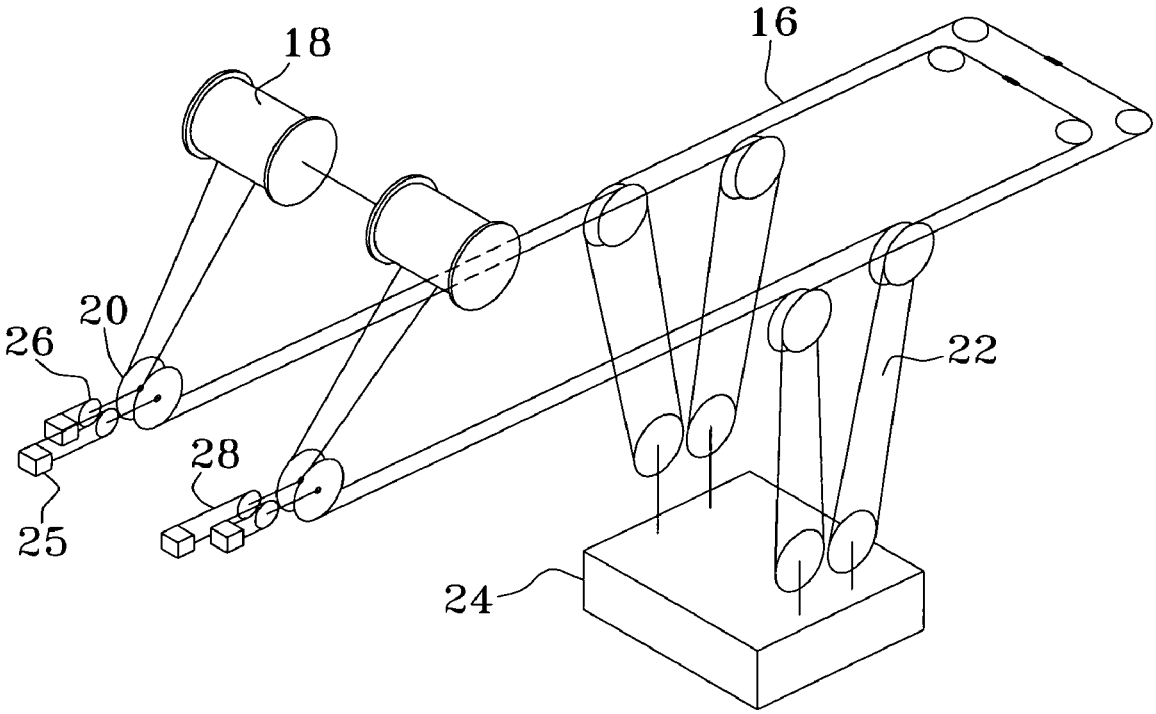
FIG. 2 is a perspective view showing the general reeving arrangement of a conventional container hoist with a first TLSS system configuration.

Container cranes are commonly found in harbors where the loading and unloading of large containers from ships, rail cars and transport trucks occurs. FIG. 2 depicts a simplified perspective view of the main hoist reeving of a typical container crane. The container crane has two main crane lifting wire ropes 16 that are spooled out or in from two main crane drums 18. These two main wire ropes 16 each traverse around the four main wire rope sheaves 20 and are arranged in four separate wire rope lifting loops 22 that hang in a vertical orientation and which attach to the four corners of the container 24 via a lifting beam (beam not illustrated). A wire rope from the TLSS system 25 runs about a TLSS sheave 26 which is mechanically affixed to one of the four main wire rope sheaves 20. When raising a container 24, the vertical length of the lifting loops 22 is adjusted by the rotation of the two main crane drums 18. When making a TLS adjustment, one or a combination of TLSS drums is rotated to spool in or out TLSS wire rope 28 so as to adjust the horizontal position of one or more of the main crane sheaves 20. This main crane sheave movement adjusts slightly the vertical length of one or more of the lifting loops 22 so as to tilt, list or skew the container lifting beam. There are four TLSS systems 25 required to enable all possible tilt, list and skew configurations.

Figure 3:
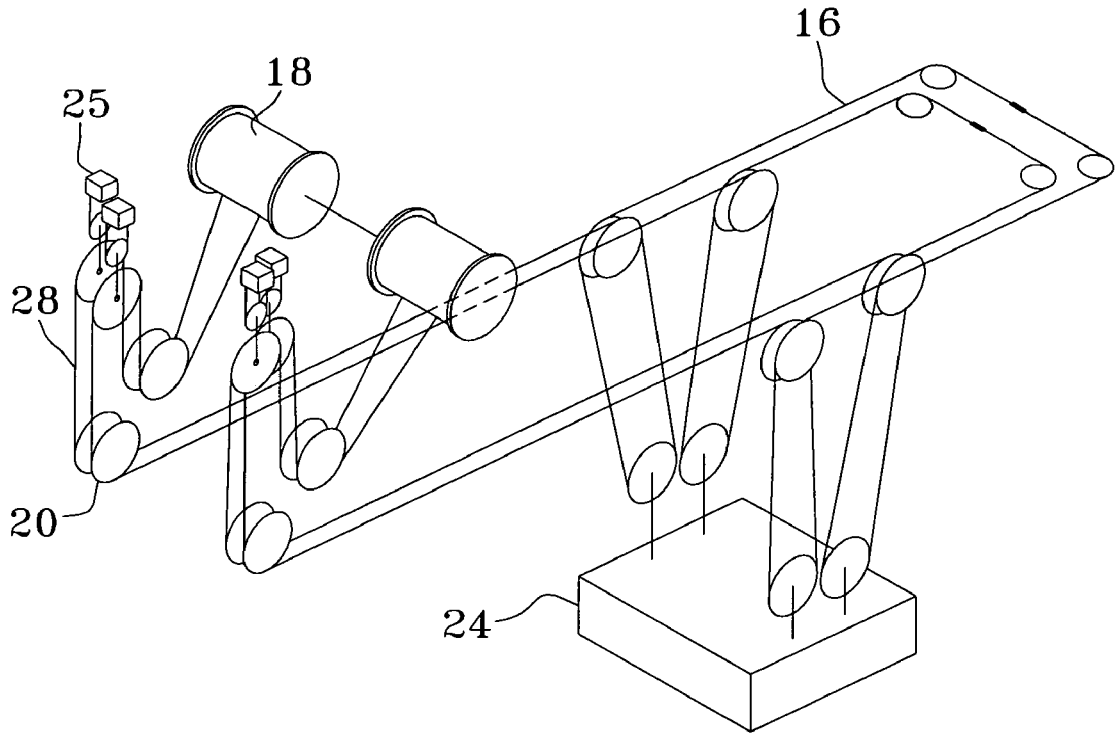
FIG. 3 is a perspective view showing the general reeving arrangement of conventional container hoist with a second TLSS system configuration.

FIG. 3 depicts a simplified perspective view of the reeving of a typical container crane with a variation on the TLSS system location and arrangement. Here an additional four main crane sheaves 20 have been utilized so as to allow the TLSS system 25 to be physically located elsewhere. The operation is otherwise, functionally identically.

Figure 5:
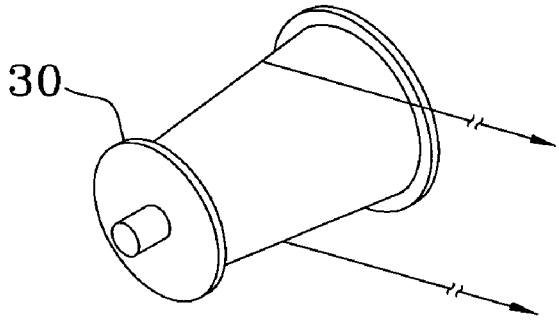
FIG. 5 is a front perspective view showing the general arrangement of a tapered, opposite wire rope wrapped drum.

FIG. 5 illustrates a consistent tapered, opposite wire rope wrapped TLSS drum 30. This drum 30, despite appearing differently, operates the same as the dual diameter, opposite wire rope wrapped drum 8 because as the wire ropes spool on and off the drum from their respective sides, the ratio of their drum diameters is maintained. This tapered drum arrangement only offers advantages for purposes of fabrication and maintenance. It offers the same effects of torque reduction and increased response time for snag events coupled with the use of a smaller friction clutch and rotational equipment.

Figure 6A:
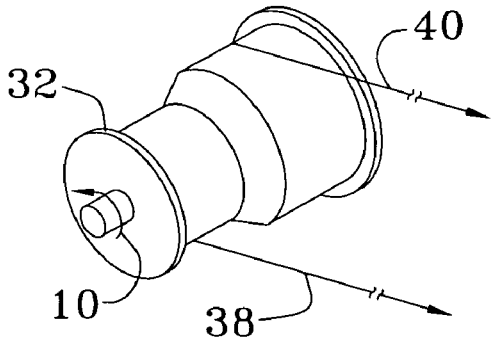
FIG. 6*a* is a front perspective view showing the general arrangement of a dual diameter, opposite wire rope wrapped drum with a center transitional taper.
Figure 6B:
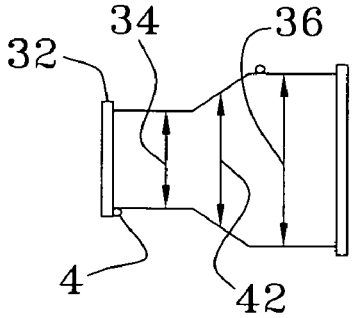
FIG. 6*b* is a side cross sectional view showing the general arrangement of a dual diameter, opposite wire rope wrapped drum with a center transitional taper

FIGS. 6*a* and 6*b* illustrates a dual diameter, opposite wire rope wrapped drum with a center transitional taper 32. Here where the small diameter 34 is d and the large diameter 36 is D, the shaft torque 10 is $Y=(T/2)(D'-d')$. However, when the left wire rope side 38 spools onto the drum 32 and climbs onto the transition diameter 42, the shaft torque 10 reduces until the left wire rope side 38 climbs onto the large diameter 36. Once the left wire rope side 38 and the right wire rope side 40 are on the same diameter 36 the same amount of wire rope is spooled out as is spooled in for every revolution of the drum. At this time the torque $Y=0$. This occurs when the hoist drum 32 is revolving counterclockwise and the midpoint of the wire rope (around the TLSS sheave 26) is moving away from the TLSS system 25 allowing the main hoist drum sheave 26 to move and lengthen the lifting loops 22 to reduce the stress on the main crane wire rope 16.

Figure 7:
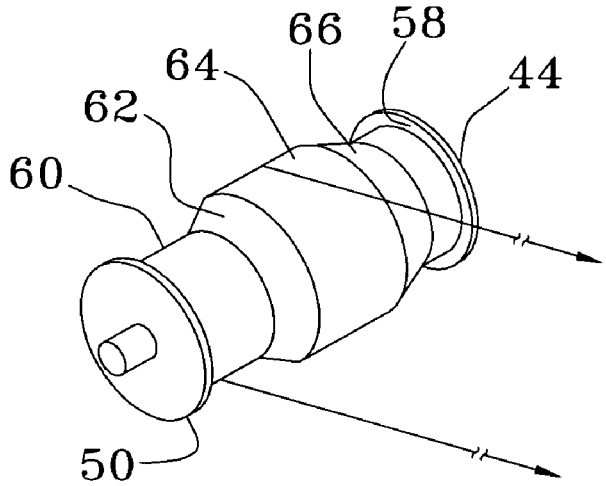
FIG. 7 is a front perspective view showing the general arrangement of a dual diameter, opposite wire rope wrapped drum with dual transitional tapers.
Figure 8:
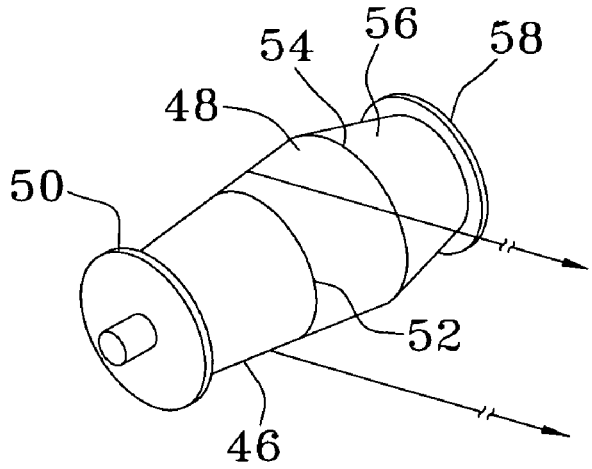
FIG. 8 is a front perspective view showing the general arrangement of a dual tapered diameter, opposite wire rope wrapped drum.

FIG. 7 and FIG. 8 although different in geometrical design, are operational equivalents. The differences in design between account for manufacturing preferences. The dual diameter, opposite wire rope wrapped drum with dual transitional tapers 44 of FIG. 7 and the a dual tapered diameter, opposite wire rope wrapped drum 46 of FIG. 8 accomplish the TLS adjustments and the snag compensation described herein, substantially similar. As can be seen, the dual tapered diameter drum 46 has a first increasing diameter taper 48 that extends from the first side of the drum 50 beyond the drum centerline 52 to a transition point 54 where a second decreasing diameter taper 56 extends to the second side of the drum 58. The dual diameter, dual transitional tapered drum 44 of FIG. 7 has four sections as follows: the primary section 60 is a fixed diameter section that extends from the first side of the drum 50 to the secondary increasing diameter section 62 which extends to the tertiary fixed diameter section 64 which extends to the quaternary decreasing diameter section 66 which extends to the second side of the drum 58.

FIGS. 9 to 15 sequentially depict the various configurations that a TLSS system undergoes when in operation. Although represented with the dual diameter, opposite wire rope wrapped drum with a dual transitional tapers 46 of FIG. 7 the operation with the dual tapered diameter, opposite wire rope wrapped drum 46 of FIG. 8 would be substantially similar in that the ratio of the diameters of the drum (taken at the present location of the left wire rope side 38 and the right wire rope side 40 on the drum) utilized to let out or spool in the wire rope sides would be identical with that of the dual diameter, opposite wire rope wrapped drum with a dual transitional tapers at all times. It is important to note that a crane drum has a spiraling groove (pitch) 70 formed on the exterior surface of the drum that serves to guide the winding of the wire rope. In all embodiments, the wire rope payout and take-up is such that there is a constant number of pitches 70 between the different sides of the of the wire rope, regardless of the position of the TLSS sheave 26.

In operation, on a conventional container crane there will be four separate TLSS systems 25 installed. Each one will control the fine adjustment of the length of one of the four main crane wire rope loops 22. Each will have its individual motor speed/gear reducer set 82 to provide the power to adjust the hoist wire rope loop length for TLS functions. The amount of power is adjusted by the main crane's computer system automatically after determining load demand and is also adjusted for differential hoist wire rope stretch.

Figure 9:
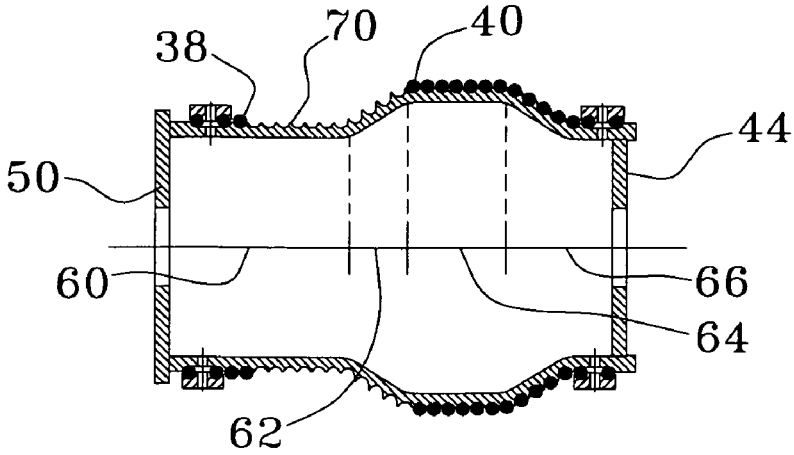
FIG. 9 is a side cross sectional view showing the general arrangement of a dual diameter, opposite wire rope wrapped drum with dual transitional tapers and the wire rope wrapped when the TLSS system is in the uppermost position.
Figure 10:
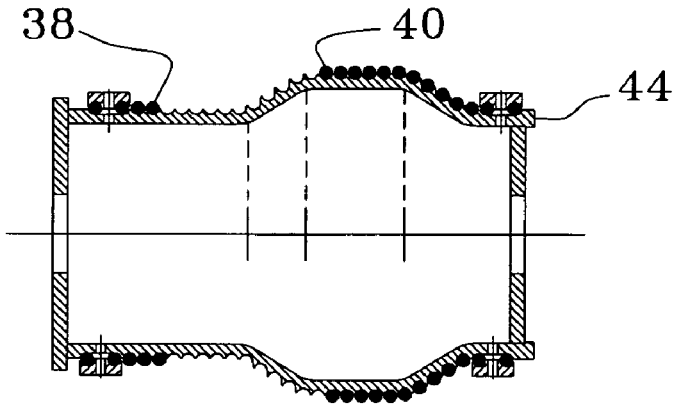
FIG. 10 is a front perspective view showing the general arrangement of a dual diameter, opposite wire rope wrapped drum with dual transitional tapers when the TLSS system is in the neutral position.
Figure 11:
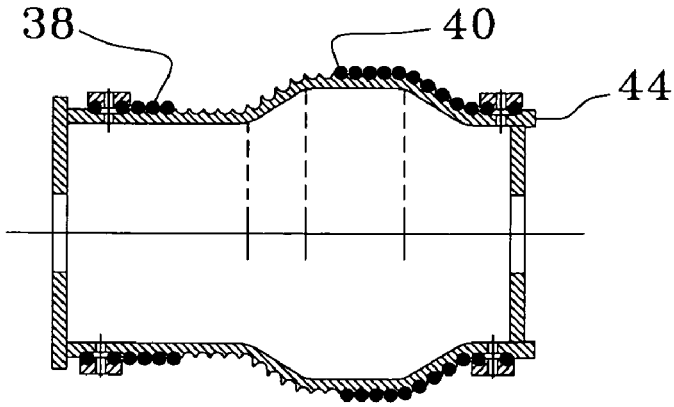
FIG. 11 is a front perspective view showing the general arrangement of a dual diameter, opposite wire rope wrapped drum with dual transitional tapers when the TLSS system is in the lowermost position.

In normal operation the TLSS system 25 must make small compensations in the TLSS sheave position to accommodate the TLS functions to get a container 24 oriented correctly to accommodate it's transfer from one location to another. The TLSS drum 44 is configured such that within the normal, calculated and expected range of TLSS sheave travel for the TLS functions, the left wire rope side 38 and the right wire rope side 40 are on drum sections that offer a constant ratio of the drum diameters so as to optimize the torque requirements for the TLSS sheave adjustments and to require a greater number of drum rotations per unit of TLSS sheave movement. These components allow for a simplier, finer control by the TLSS system 25 over the TLS movements. FIGS. 9-11 illustrate the TLSS drum 44 in it's normal operating range for TLS functions.

FIG. 9 shows the TLSS drum 44 and wire ropes when in the uppermost position for TLS adjustments. TLSS left side wire rope 38 resides in pitches 70 on the primary fixed diameter section 60 and the right wire rope side 40 resides in pitches 70 on the tertiary fixed diameter section 64 at the interface of the tertiary fixed diameter section 64 and the secondary increasing diameter section 62.

FIG. 10 shows the TLSS drum 44 and wire ropes when in the neutral (or mid range) position for TLS adjustments. TLSS left side wire rope 38 resides in pitches 70 on the primary fixed diameter section 60 and the right wire rope side 40 resides in pitches 70 on the tertiary fixed diameter section 64. There is more TLSS wire rope 28 wound on the primary fixed diameter section 60 and less on the tertiary fixed diameter section 64 than in the uppermost position, but the number of pitches between the TLSS left side wire rope 38 and the TLSS right side wire rope 40 is the same as for the uppermost position for TLS adjustments (and will remain this way throughout all operational modes).

FIG. 11 shows the TLSS drum 44 and wire ropes when in the lowermost position for TLS adjustments. TLSS left side wire rope 38 still resides in pitches 70 on the primary fixed diameter section 60 and the right wire rope side 40 still resides in pitches 70 on the tertiary fixed diameter section 64. There is again more TLSS wire rope 28 wound on the primary fixed diameter section 60 and less on the tertiary fixed diameter section 64 than in the neutral position and the uppermost position.

In the snag function mode, as illustrated by FIGS. 12-15 the left side wire rope 38 moves onto the secondary increasing diameter section 62 and onto the tertiary fixed diameter section 64 while the right wire rope side 40 moves off the tertiary fixed diameter section 64 and on to the quaternary decreasing diameter section 64 so as to adjust the torque from a positive value through zero to a negative value. This enables the snag desirable features as previously disclosed.

Figure 12:
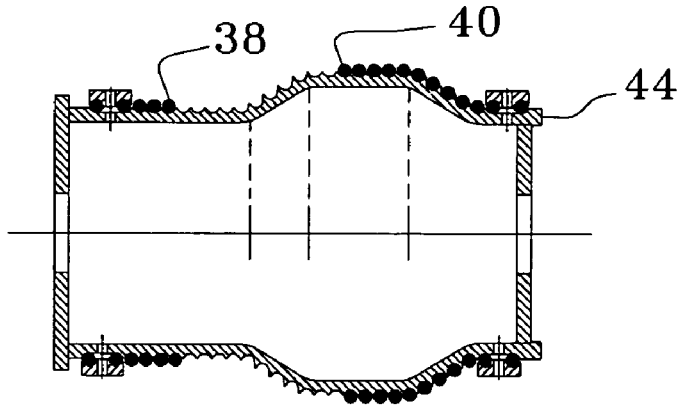
FIG. 12 is a front perspective view showing the general arrangement of a dual diameter, opposite wire rope wrapped drum with dual transitional tapers when the TLSS system is in the snag starting position.

FIG. 12 illustrates a conservative estimate of the TLSS wire rope 26 location where the earliest a snag could begin. At this time there is still the maximum positive torque developed by the TLSS system 25 but in the number of drum rotations necessary to get to the normal snag stop position the quick responding TLSS system 25 should have compensated for the snag.

Figure 13:
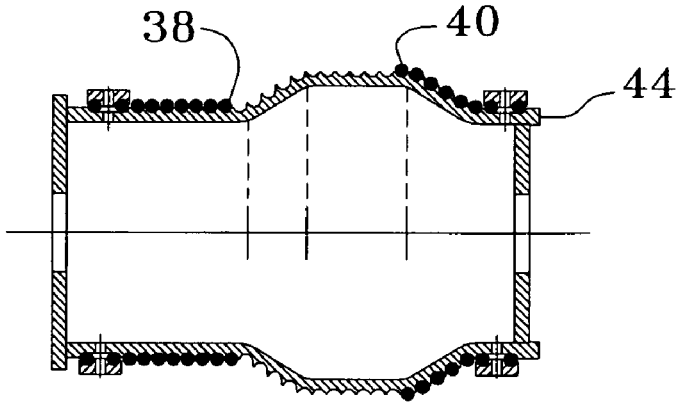
FIG. 13 is a front perspective view showing the general arrangement of a dual diameter, opposite wire rope wrapped drum with dual transitional tapers when the TLSS system is in the normal snag stop position.
Figure 14:
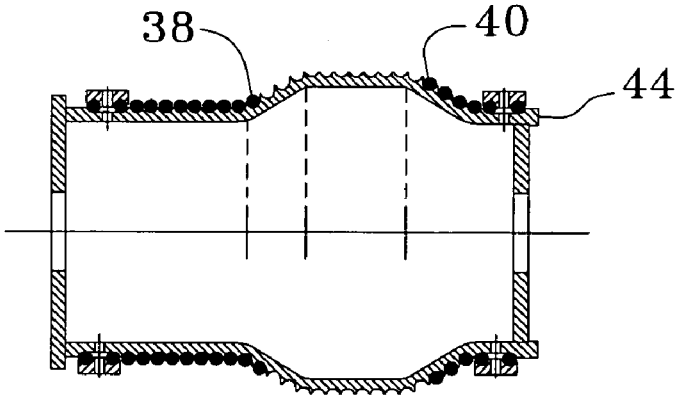
FIG. 14 is a front perspective view showing the general arrangement of a dual diameter, opposite wire rope wrapped drum with dual transitional tapers when the TLSS system is in the snag overtravel position.

In FIG. 13, the normal TLSS wire rope 26 position where snags are stopped is illustrated. Should the TLSS system 25 not have compensated for the snag and tension in the main crane wire ropes 28 continues to increase, the torque begins to reduce to zero as the left wire rope side 38 and the right wire rope side 40 move onto their respective increasing and decreasing diameter drum sections as shown in FIG. 14.

Figure 15:
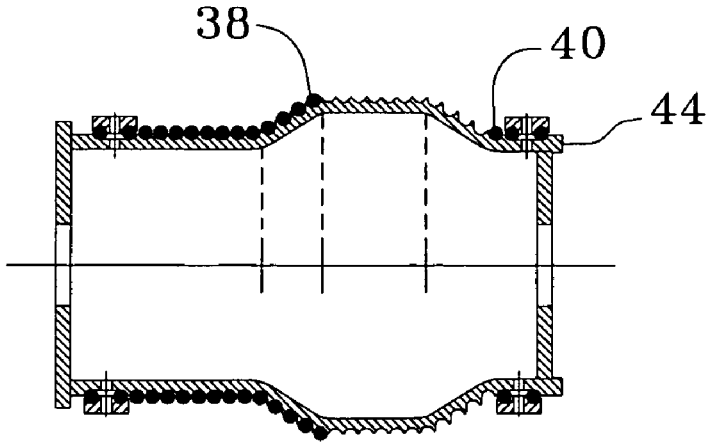
FIG. 15 is a front perspective view showing the general arrangement of a dual diameter, opposite wire rope wrapped drum with dual transitional tapers when the TLSS system is in the snag overtravel end position.

If the snag has not been fully compensated for by this time, the torque becomes negative as the left wire rope side 38 continues onto the tertiary fixed diameter section 64 and the right wire rope side 40 moves further down the quaternary decreasing diameter section 66 as shown in FIG. 15.

Snags are calculated to occur at certain elevations of the main crane's wire rope loops 22 which correspond to certain positions of the TLSS sheaves 26. The TLSS drums are designed so that when the TLSS sheaves are in expected snag locations, the left TLSS wire rope side 38 and right TLSS wire rope side 40 are on TLSS drum sections that begin reducing the torque and slowing the movement of the TLSS sheaves 26. The diameter of the TLSS drum section that the wire rope spooling in resides on will be increasing in diameter, and the diameter of the TLSS drum section that the wire rope spooling out resides on will be decreasing in diameter. If the snag is longer in duration than calculated (I.E. slow response of the main crane's computer, main crane drum rotation and main crane brakes) the right TLSS wire rope side 40 and left TLSS wire rope side 38 continue to spool on or off of TLSS drum sections that reduce the torque to zero and stop the movement of the TLSS sheaves 26.

If the snag continues in duration the diameter of the TLSS drum section that the wire rope spooling in resides on will be larger in diameter than the diameter of the TLSS drum section that the wire rope spooling out resides so as to offer negative (reverse) torque and to have a net release of TLSS wire rope from the TLSS drum thus allowing the TLSS sheave 26 to move so as to compensate for the tension building in the cranes loops 22. This is an extra safety precaution to make it nearly impossible to break the TLSS wire rope end attachment free from the TLSS drum 44.

When a snag event occurs, generally the main crane drum 18 is spooling up the main crane wire rope loops 25 at a high rate of speed. (This is fastest if there is no load.) Because of wire rope stretch the tension does not build instantaneously but rather takes a fraction of a second to rise to the preset level where the main crane's tensiometer detects an increase in load commensurate with a snag. The preset level must have enough margin to allow for the balancing of a load (generally 25%) or the crane would be stopping unnecessarily on a regular basis. Generally the main crane tensiometer reacts to a snag at 25% beyond the normal balancing limits for the load. This results in a fraction of a second lost reaction time before the main crane's computer can differentiate a snag event from a load balancing event and stop the crane drum from turning and apply the main crane's brakes. It is within this fraction of a second that damage is done if the TLSS system 25 does not come into play.

To compensate for this long reaction time of the main crane drum operation (approximately 0.3 seconds), the TLSS system friction coupling or friction brake 84, which is precisely preset for a specified slip torque, releases the TLSS gearbox 82 from the TLSS drum 44 in a controlled fashion. This is precisely coordinated with the location of the TLSS wire rope 28 on specific sections of the TLSS drum 44 designed so that the TLSS torque is optimal for snag compensation or snag reset. This is a passive system and does not require input from the main crane's computer. It is able to stop the TLSS drum 44 from rotating by the friction clutch 84. The drum 44 is not freewheeling, but can let the wire rope 26 spool rapidly away for the fraction of a second it takes for the main crane's drum 18 to stop rotating and for the hoist breaks to set, Thereby avoiding snag damage or broken main crane wire ropes 22.

Keeping in mind that the TLSS system 25 is designed to operate within a narrow specified length of the main crane wire rope loops 22 (that length between where the containers are raised and lowered). The various TLSS drum diameters, the longitudinal axis length of the TLSS drums and the longitudinal axis length of the various drum sections are designed for specific main crane applications and the TLSS wire rope is on specific drum sections at specific vertical heights of the main crane wire rope loops 22. It is these parameters that enable the TLSS system to function so precisely for normal TLS functions and so quickly for snag events.

The above detailed invention relates primarily to use with container cranes. Such units are commonly found around harbor docks. These cranes remain at a fixed height from the containers they lift, and most of the repetitive lifts are done with similar amounts of vertical wire rope travel by the main crane wire rope loops 22. Because of this, the location of the TLSS wire rope sides upon the discrete TLSS drum sections are known with relative certainty and specificity. TLSS drums can thus easily be designed for different cranes.

Figure 16:
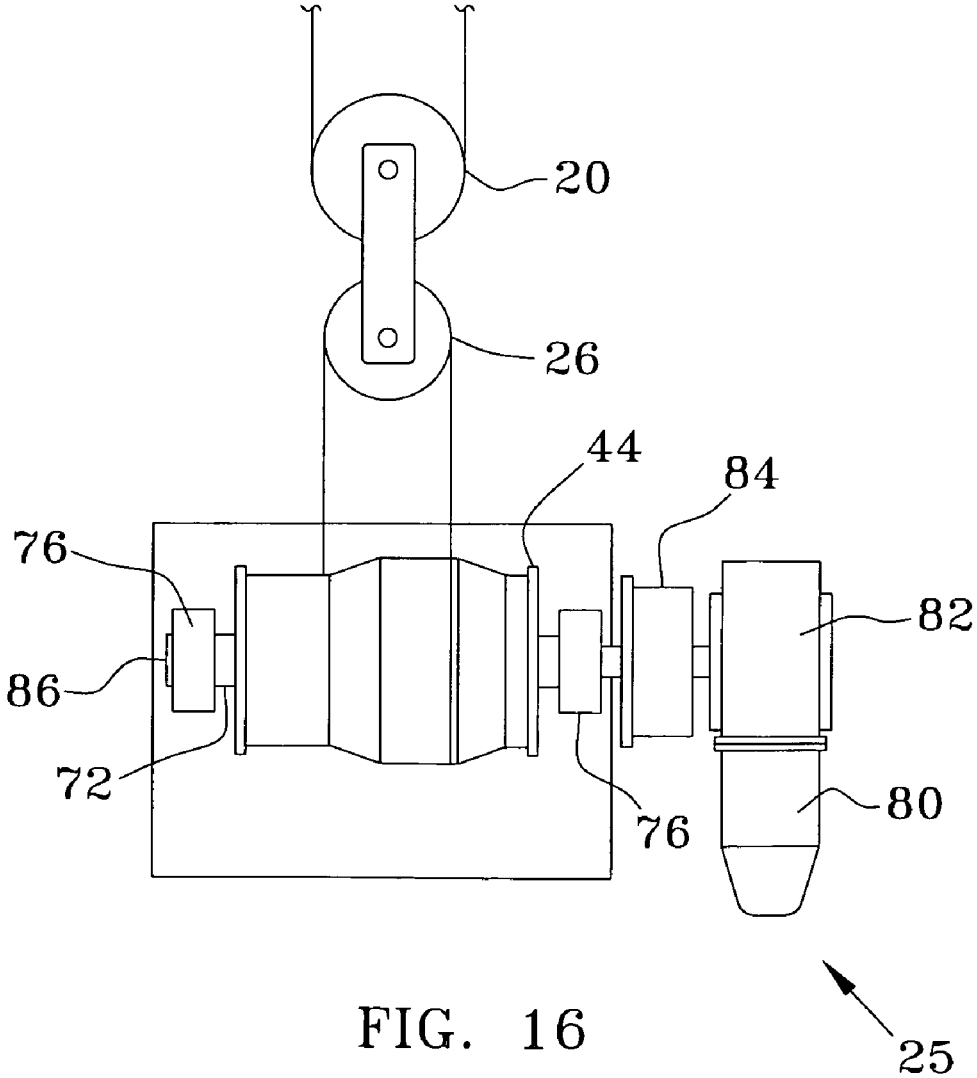
FIG. 16 is a top view of the TLSS system with an external friction clutch and encoder and a dual diameter, opposite wire rope wrapped drum with dual transitional tapers.
Figure 17:
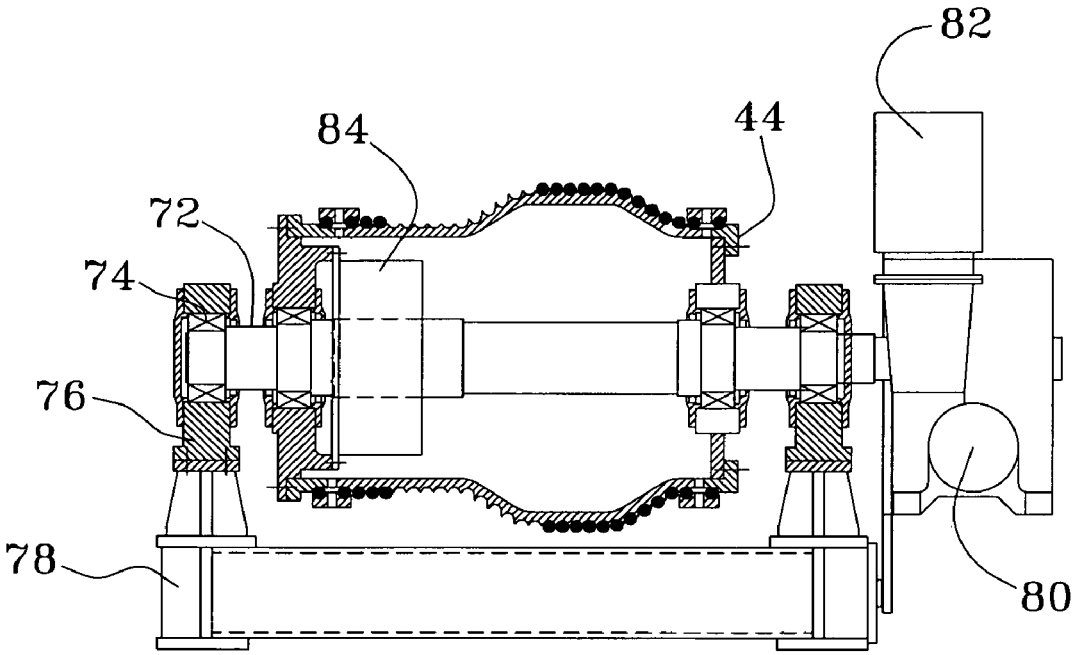
FIG. 17 is a cross sectional view of the TLSS system with an internal friction clutch and a dual diameter, opposite wire rope wrapped drum with dual transitional tapers.

Looking at FIGS. 16 and 17 views of the TLSS system dual diameter, opposite wire rope wrapped drum with dual transitional tapers 44 the remaining elements that comprise the TLSS system 25 can best be seen. Drum 44 is mounted upon axle 72 that has bearings 74 affixed at or near the axle's distal and proximate ends. The bearings 74 reside in pillow block assemblies 76 rigidly attached mechanically to a mountable base 78. One end of the axle 72 is connected to a gearbox 82. A friction clutch/brake 84 may be mounted internal to the drum 44 about the axle 72 (as shown if FIG. 17) or may be mounted external to the drum 44 about the axle 72 (as shown if FIG. 18). The TLSS system feedback signal to the main crane computer is developed and sent by an encoder 86 (illustrated on FIG. 16). It is well known in the art that the TLSS system components besides the drum 44 itself, may have plethora of different configurations that accomplish the features of turning and braking the drum rotation, to numerous to delineate herein.

It is to be noted that the spacing, more specifically the number of pitches 70 between the TLSS wire rope 28 when on a TLSS drum never changes. Each TLSS drum has its size, tapers, section diameters and wire rope wraps designed for a specific crane system based on the normal operating length ranges of the TLSS wire rope 28. By using various combinations of multiple drum regions with different drum diameters, a precise, fast acting TLSS system 25 using conventional electric motors can be designed to meet the specific needs of a crane's TLSS system 25.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A crane apparatus for the controlled length adjustment of a cable having two ends affixed to, and wound about a line spooling hoist drum comprising:

said hoist drum having a proximate end, a distal end, and a longitudinal axis of rotation;

four drum sections taken perpendicular to the longitudinal axis of said drum wherein said adjacent drum sections have different diameter profiles; and a cable having a first end and a second end, wherein said four drum sections comprise:

a first generally cylindrical drum section having a first diameter:

an intermediate drum section having a tapered diameter profile positioned between said first drum section and said second drum section;

a second generally cylindrical drum section having a second diameter positioned between said intermediate drum section and said drum tail section; and a tapered profile drum tail section having a tapered diameter positioned adjacent said second drum section;

wherein said first diameter is less than said second diameter and said intermediate drum section has a tapered or frustaconical diameter profile having a proximate end with a diameter substantially similar to that of said first drum section and a distal end with a diameter substantially similar to that of said second drum section, and said drum tail section has a tapered or frustaconical diameter profile having a proximate end with a diameter substantially similar to that of said second drum section, and wherein said first end of said cable is clockwise wound onto said drum and mechanically affixed to said drum at the proximate end, and said second end is counter-clockwise wound onto said drum and mechanically affixed at the distal end of said drum.

2. The crane apparatus of claim 1 wherein said intermediate drum section and said drum tail section have inverse tapers.

3. The crane apparatus of claim 1 wherein said cable is a wire rope.

4. The crane apparatus of claim 1 further comprising:

a friction clutch;

a drive motor and gearbox assembly for electro/mechanical rotation of said hoist drum;

a shaft;

at least two shaft bearings;

a mounting base having at least two shaft bearing housings extending therefrom; and an electronic position feedback device;

a brake;

wherein said friction clutch and said hoist drum are mounted on said shaft such that their rotation axes are aligned with a longitudinal axis of said shaft and are disposed between said shaft bearings which are mechanically affixed to said shaft and reside in said shaft bearing housings, and wherein said drive motor and gearbox assembly are mechanically coupled to said shaft so as to enable controlled rotation of said drum in accordance with signals received from said electronic control system to adjust the length said cable extends from said drum.

5. The crane apparatus of claim 4 further comprising a sheave, wherein said cable extends around said sheave such that an adjustment in the length of said cable acts to adjust the distance of said sheave from said hoist drum.

* * * * *